US008683806B2

(12) United States Patent
Commaret et al.

(10) Patent No.: US 8,683,806 B2
(45) **Date of Patent: *Apr. 1, 2014**

(54) CHAMBER-BOTTOM BAFFLE, COMBUSTION CHAMBER COMPRISING SAME AND GAS TURBINE ENGINE FITTED THEREWITH

(71) Applicant: SNECMA, Paris (FR)

(72) Inventors: Patrice Andre Commaret, Rubelles (FR); Didier Hippolyte Hernandez, Quiers (FR); Romain Nicolas Lunel, Montereau sur le Jard (FR)

(73) Assignee: SNECMA, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/958,000

(22) Filed: Aug. 2, 2013

(65) Prior Publication Data

US 2013/0312420 A1 Nov. 28, 2013

Related U.S. Application Data

(62) Division of application No. 12/165,995, filed on Jul. 1, 2008, now abandoned.

(30) Foreign Application Priority Data

Jul. 5, 2007 (FR) ..... 07 04869

(51) Int. Cl.
*F02C 1/00* (2006.01)

(52) U.S. Cl.
USPC ..... 60/752; 60/756

(58) Field of Classification Search
USPC ..... 60/737, 738, 740, 748, 752–760, 800
See application file for complete search history.

(56) References Cited

U.S. PATENT DOCUMENTS

| | | | | |
|---|---|---|---|---|
| 4,480,436 | A * | 11/1984 | Maclin | 60/796 |
| 4,843,825 | A | 7/1989 | Clark | |
| 5,799,491 | A | 9/1998 | Bell et al. | |
| 6,164,074 | A * | 12/2000 | Madden et al. | 60/752 |
| 7,121,095 | B2 * | 10/2006 | McMasters et al. | 60/746 |
| 7,770,398 | B2 | 8/2010 | De Sousa et al. | |
| 7,908,866 | B2 | 3/2011 | Kato et al. | |

FOREIGN PATENT DOCUMENTS

| | | |
|---|---|---|
| EP | 0 521 687 A1 | 1/1993 |
| GB | 2 247 522 A | 3/1992 |

* cited by examiner

*Primary Examiner* — Ehud Gartenberg
*Assistant Examiner* — Arun Goyal
(74) *Attorney, Agent, or Firm* — Oblon, Spivak, McClelland, Maier & Neustadt, L.L.P.

(57) ABSTRACT

A baffle for the bottom of a combustion chamber of a gas turbine engine is disclosed. The baffle includes a flat portion of wall with an opening for an injector of the combustion chamber to pass through, two longitudinal edges for the assembly to two adjacent baffles and two transverse edges. At least one of the edges includes a joint cover arranging a housing along the edge for an edge of an adjacent baffle so as to seal the junction between the two edges. A combustion chamber incorporating the baffles is also disclosed.

14 Claims, 14 Drawing Sheets

CHAMBER-BOTTOM BAFFLE, COMBUSTION CHAMBER COMPRISING SAME AND GAS TURBINE ENGINE FITTED THEREWITH

CROSS-REFERENCE TO RELATED APPLICATIONS

This application is a division of U.S. application Ser. No. 12/165,995 filed Jul. 1, 2008, the entire contents of which is incorporated herein by reference. U.S. application Ser. No. 12/165,995 is based upon and claims the benefit of priority from prior French Application No. 0704869 filed Jul. 5, 2007.

BACKGROUND OF THE INVENTION

The present invention relates to the technical field of combustion chambers for gas turbine engines. Its particular subject is the chamber bottom. Its final subject is a gas turbine engine such as a turbojet fitted with such a combustion chamber.

In all of the following, the terms "axial", "radial", "transverse" correspond respectively to an axial direction, to a radial direction, and to a transverse plane of the engine, the terms "upstream" and "downstream" correspond respectively to the direction of flow of the gases in the engine.

A conventional divergent combustion chamber is illustrated in FIG. 1, which is an axial section showing a half of the combustion chamber, the other half of the latter being deduced by symmetry relative to the axis of the engine (not shown). The combustion chamber 110 is housed in a diffusion chamber 130 that is an annular space defined between an outer casing 132 and an inner casing 134, in which a compressed comburant, ambient air, originating upstream of a compressor (not shown) is inserted via an annular diffusion duct 136.

This divergent combustion chamber 110 comprises two concentric walls, one outer 112 and the other inner 114, that are coaxial and substantially conical. The walls flare out from upstream to downstream. The outer wall 112 and inner wall 114 of the combustion chamber 110 are connected together, toward the upstream of the combustion chamber, by a chamber bottom 116.

The chamber bottom 116 is a frustoconical annular part which extends between two substantially transverse planes while flaring out from downstream to upstream. The chamber bottom 116 is connected to each of the two walls, outer 112 and inner 114, of the combustion chamber 110. The chamber bottom 116 is slightly conical. It is furnished with injection systems 118 through which injectors 120 pass that insert the fuel at the upstream end of the combustion chamber 110 where the combustion reactions take place.

These combustion reactions have the effect of causing heat to radiate from downstream to upstream in the direction of the chamber bottom 116. Therefore in operation the chamber bottom is subjected to high temperatures. In order to protect it, sectorized heat screens, also called baffles 122, are placed between the center and the walls of the chamber bottom. These baffles 122, one of which is represented in FIG. 3, are substantially flat plates attached by brazing to the chamber bottom 116 with a central opening 122*a* for the injection system to pass through. They comprise two low lateral walls 122*b* 122*c* along the radial edges, turned toward the wall of the chamber bottom and two air guidance tongues 122*e* 122*f* along the transverse edges turned toward the center and arranging a space with the inner, respectively outer, walls 114 and 112 of the chamber. The baffles are cooled by the impacts of cooling air jets entering the combustion chamber 110 through cooling orifices 124 pierced in the chamber bottom 116. The air forming these jets, flowing from upstream to downstream, is guided by chamber fairings 126, passes through the chamber bottom 116 through the cooling orifices and comes to impact the upstream face of the baffles 122. The air is then guided radially toward the inside and outside of the center in order to initiate the film for cooling the walls 114 and 112 respectively.

This guidance along the baffles is ensured by the radially-oriented lateral low walls. These low walls also have a sealing function. Being in contact with or providing a minimal clearance with the chamber bottom, they prevent the air from mixing between two adjacent baffles, entering the center and disrupting the combustion. These disruptions have an impact on pollution and are to be avoided. Specifically, the performance in discharge of pollutants, CO and CHx, are capable of being harmed by the undesirable insertion of this cold air particularly when the engine is idling when the clearance is greatest.

DESCRIPTION OF THE PRIOR ART

In the context of other engine architectures in which the gas flow is generally convergent between the outlet of the compressor and the inlet of the turbine, there are combustion chambers that are called convergent; the outer and inner walls of the combustion chamber are inclined while flaring out from downstream to upstream, and not from upstream to downstream as with the first combustion chambers mentioned above, called divergent. These convergent combustion chambers may have a larger cone angle than the cone angle of the divergent combustion chambers.

Such a great inclination of the combustion chamber has repercussions on the conicity of the chamber bottom and on the position of the baffles relative to the chamber bottom. Such a combustion chamber is partly illustrated in FIG. 2, in axial section. This figure shows an axial direction 100 parallel to the axis of the turbojet, the main direction 200 of the combustion chamber 210, and the angle $\alpha$ between these two axes 100, 200. Because of the great inclination of the combustion chamber 210, the chamber bottom 216 has a conicity with a greater angle for a convergent combustion chamber bottom. When not only the inclination of the chamber bottom 216 is great, but also the injectors 220 are present in reduced number and/or the combustion chamber 210 has a small diameter, this affects the distance between the chamber bottom and the flat baffles.

Therefore the geometry of the chamber bottom may also render difficult the adjustments and tolerances necessary between the wall of the chamber bottom and the baffles. The optimal operation of the chamber is no longer ensured. The variation of the clearance between the baffles on the one hand and the baffles and the chamber bottom on the other hand is sufficiently great for the solution using low lateral walls along the radial edges of the baffles to be no longer satisfactory.

SUMMARY OF THE INVENTION

The object of the present invention is to remedy this problem.

According to the invention, a baffle for the bottom of a combustion chamber of a gas turbine engine is made comprising a portion of wall with an opening for an injection system of the combustion chamber to pass through, two longitudinal edges and two transverse edges, wherein at least one of the longitudinal edges comprises a joint cover arranging a housing along said edge for a fitted tongue or the edge of an adjacent baffle so as to seal the junction between said edge and the edge of an adjacent baffle.

The solution of the invention consists therefore in sealing the space between the baffles so as not to be reliant on the geometry of the combustion chamber and of the chamber bottom in particular and to be able to absorb the dimensional variations associated with the operation of the chamber between idling speed and full throttle.

Various solutions are proposed:

The housing is formed by a crank of the wall.

The housing is formed by a groove.

The transverse edges comprising a curved portion of wall, the housings are arranged equally along the longitudinal edges of said curved portion.

The baffle comprises a joint cover along a longitudinal edge and an edge without a joint cover along the other longitudinal edge, the two edges being matched in order to adapt to an edge of another same baffle placed edge-to-edge.

The baffle comprises a joint cover along the two longitudinal edges.

The baffle comprises two longitudinal edges matching the joint covers.

The present invention also relates to a combustion chamber of a gas turbine engine, that is annular comprising an outer wall, an inner wall, a wall connecting the two walls and forming a chamber bottom, and a plurality of baffles according to the invention with a portion of wall parallel to the chamber bottom, fitted in the bottom.

According to the embodiments:

All the baffles are identical or else.

The baffles with joint covers alternate with the baffles without joint covers.

The chamber bottom comprises radial channels arranging air gaps between the chamber bottom and the joint covers.

The combustion chamber is of the convergent type.

BRIEF DESCRIPTION OF THE DRAWINGS

Other features and advantages will emerge from the following description of embodiments of the invention with reference to the appended drawings in which.

DESCRIPTION OF THE PREFERRED EMBODIMENTS

Figure 1:
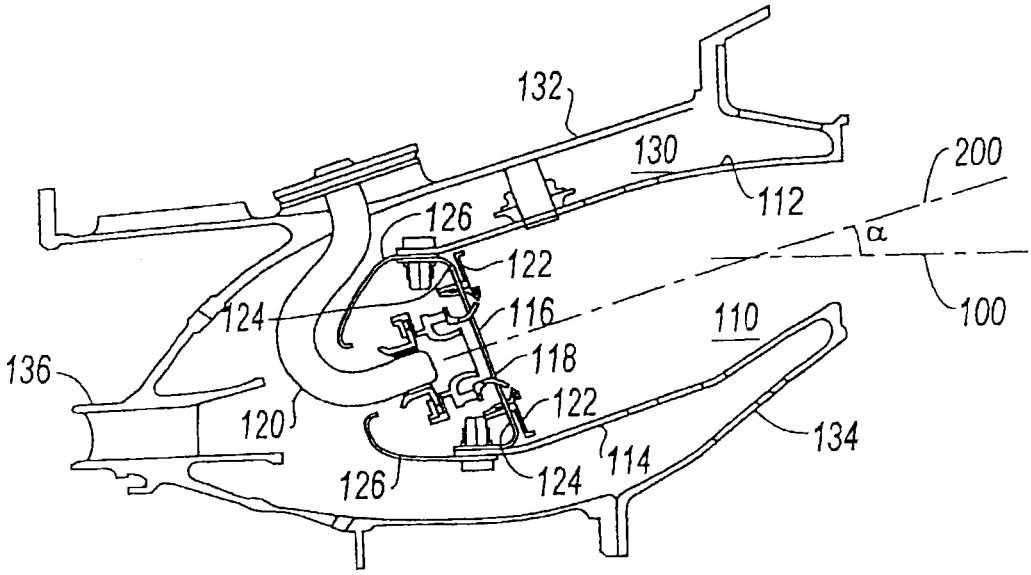
Fig. 1 PRIOR ART
FIG. 1 represents in axial section a half of a combustion chamber of the divergent type known per se.
Figure 2:
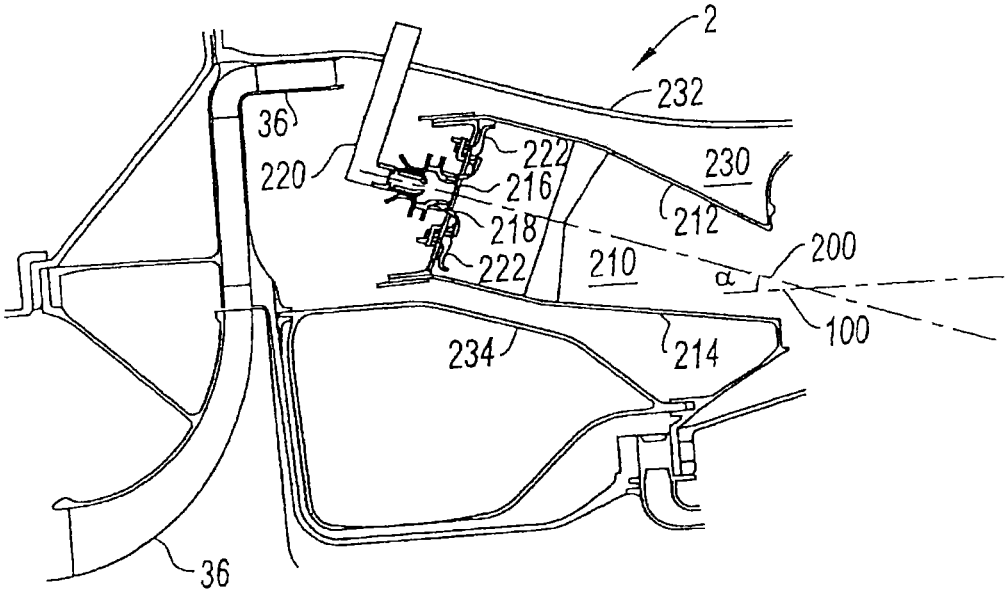
Fig. 2 PRIOR ART
FIG. 2 represents in axial section a half of a combustion chamber of the convergent type known per se.
Figure 3:
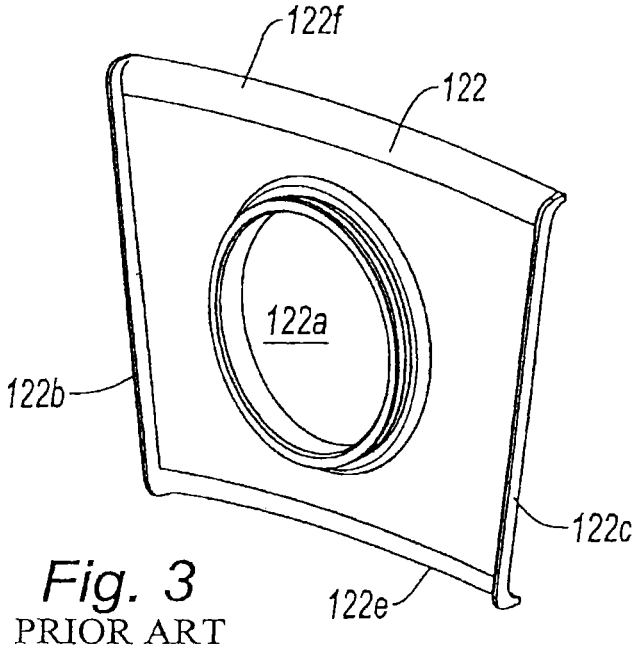
Fig. 3 PRIOR ART
FIG. 3 shows a baffle of the prior art used for the thermal protection of the wall of the combustion chamber bottom.
Figure 4:
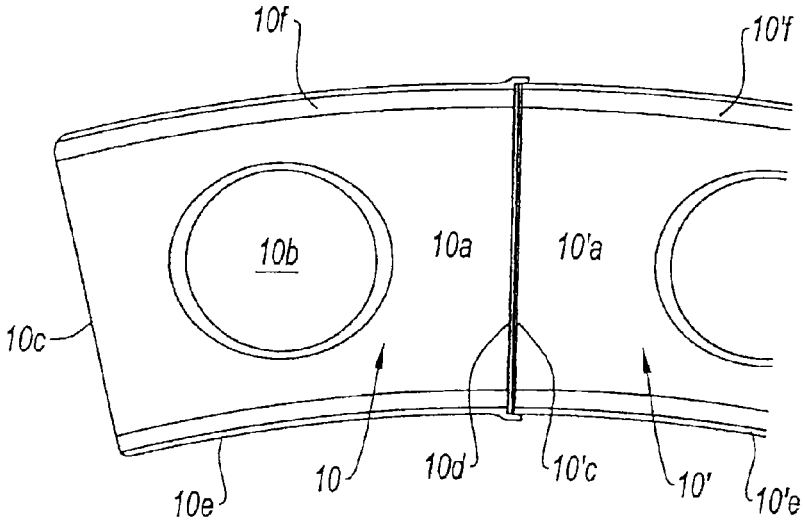
FIG. 4 shows, seen from the inside of the combustion chamber, two adjacent baffles for the thermal protection of the chamber bottom of the invention.
Figure 5:
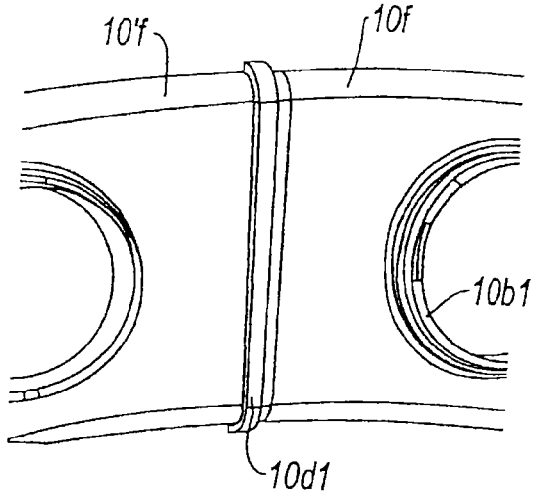
FIG. 5 shows the other face of the baffles of FIG. 4.
Figure 6:
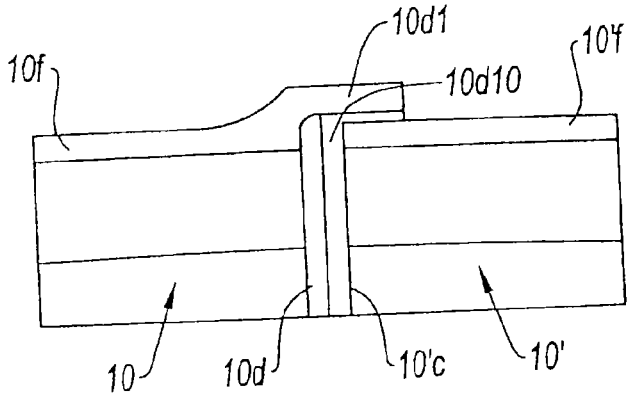
FIG. 6 shows the detail of the joint cover of the baffles of FIGS. 4 and 5.

Reference is now made to FIGS. 4 to 6 representing a first embodiment of the seal between two baffles 10 and 10' made of refractory material placed side by side on the chamber bottom. The baffle 10 comprises a flat portion 10*a* with a central opening 10*b* corresponding to the housing of an injection system not shown. In FIG. 5, the opening is bordered by a collar 10*b*1 with a shoulder for attachment in the chamber bottom. The baffle comprises two longitudinal edges that are oriented in a radial direction relative to the axis of the engine, when it is in position. The longitudinal edge 10*c* and the edge 10*d* are rectilinear. The baffle 10 also comprises two transverse edges 10*e* and 10*f* both rounded to follow the curvature of the combustion chamber and curved toward the inside of the combustion chamber for the guidance of the air. The edge 10*c*, on the left in FIG. 4, is rectilinear and follows the radial profile of the baffle. The edge 10*d* of the other side comprises a rear crank relative to the visible face in FIG. 4, formed by a tongue 10*d*1 which extends the rear face of the baffle wall. This crank forms a longitudinal housing 10*d*10 for the edge 10'*c* of the adjacent baffle 10'. This baffle 10' is identical to the baffle 10. It comprises a flat portion 10'*a*, two longitudinal edges 10'*c* and 10'*d* and two rounded and curved transverse edges 10'*e* and 10'*f*. The edge 10'*d* comprises a longitudinal tongue 10'*d*1 arranging a housing 10'*d*10.

In the example of FIGS. 4 to 6, the baffles are all identical and are installed on the periphery of the chamber bottom while being attached by the collars of the openings for the injection systems. There is one injection system per baffle. The joint cover formed by the tongue 10*d*1 of each of the baffles covers the edge 10'*c* of the adjacent baffle 10' over a sufficient width to accommodate the variations of expansion of the combustion chamber. Each housing 10*d*10, 10'*d*10 is arranged to retain the edge 10*c*, 10'*c* of the adjacent baffle so that the leaks between two adjacent baffles are reduced if not totally eliminated irrespective of the engine speed.

In the embodiment of FIGS. 4 to 6, the baffles are identical but the solution also comprises the case in which a first baffle comprises a joint cover along the two longitudinal edges interacting with the simple edges of a second baffle without joint cover. The effectiveness is the same. The installation is however different and requires the manufacture of two part references.

Figure 7:
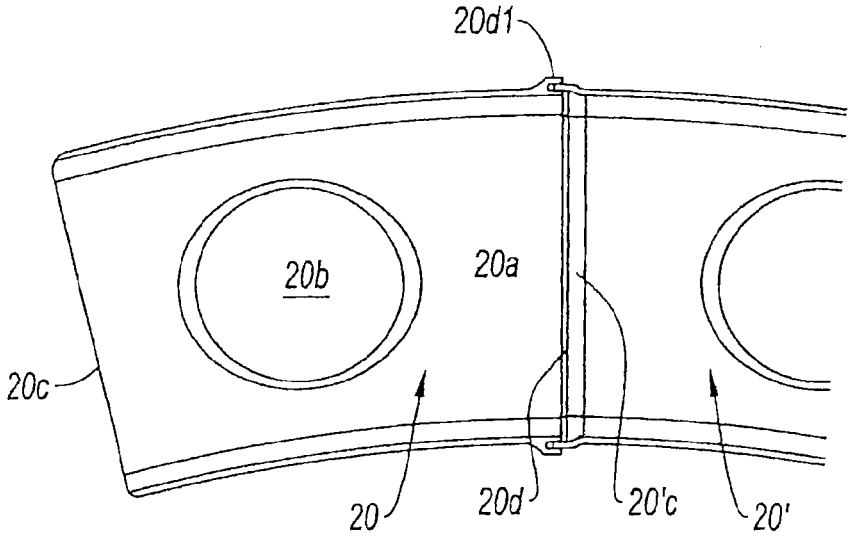
FIG. 7 shows a variant embodiment of the seal between two adjacent baffles.
Figure 8:
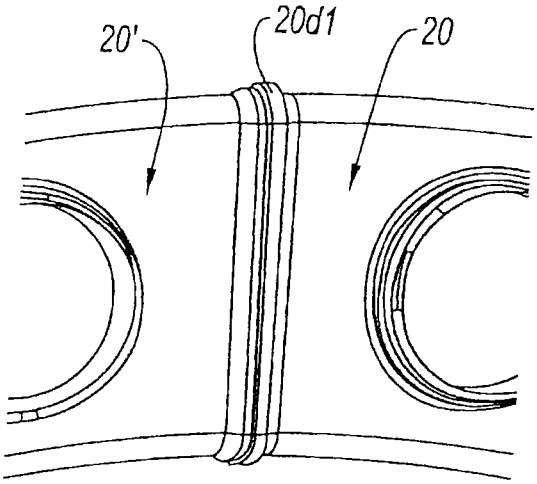
FIG. 8 shows the other face of the baffles of FIG. 7.
Figure 9:
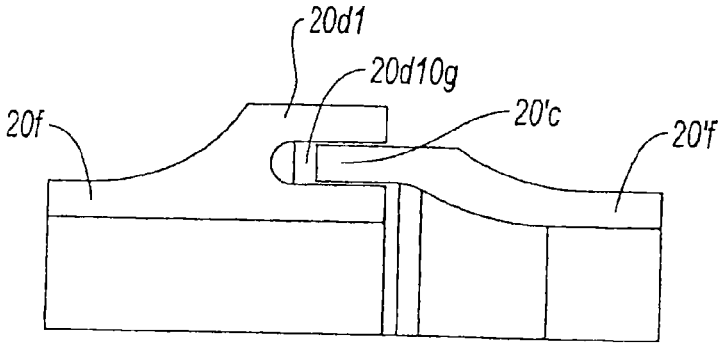
FIG. 9 shows the detail of the joint cover of the baffles of FIGS. 7 and 8.

FIGS. 7, 8 and 9 represent a first variant with a grooved joint cover which improves the seal relative to the previous solution.

This shows the baffles 20, 20' with a flat wall 20*a*, 20'*a*, a central opening 20*b*, 20'*b*, two longitudinal edges 20*c*, 20'*c* and 20*d*, 20'*d*, and two rounded and curved transverse edges 20*e*, 20'*e* and 20*f*, 20'*f*. The longitudinal edge 20*d* comprises a tongue 20*d*1 parallel to the wall of the baffle and arranging a groove-shaped housing 20*d*10*g*. This groove is arranged so as to interact with the edge 20'*c* of the adjacent baffle. Here the edge 20'*c* forms a rear crank to engage in the groove 20*d*10*g*. The clearance is sufficient to allow the expansion of the combustion chamber during the various engine speeds while retaining a sealed contact between the edge 20'*c* and the sides of the groove 20*d*10*g*.

As in the previous solution, the baffles may be all identical or may alternate: one with joint covers on the two edges and the other with simple edges interacting with the grooves of the edges with joint covers.

Figure 10:
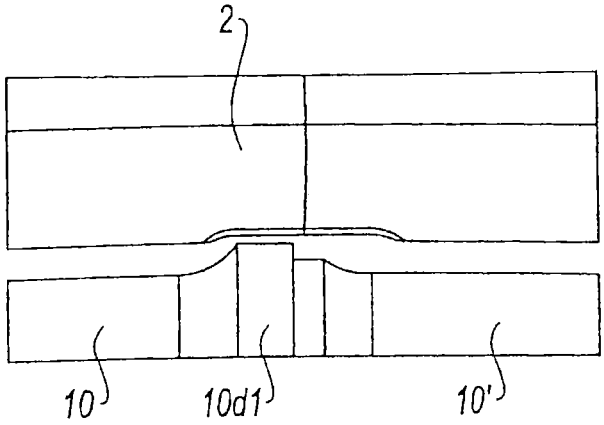
FIG. 10 is a view showing a radial channel arranged in the wall of the chamber bottom to allow the achievement of an air gap between the wall of the chamber bottom and the joint cover of the baffles.
Figure 11:
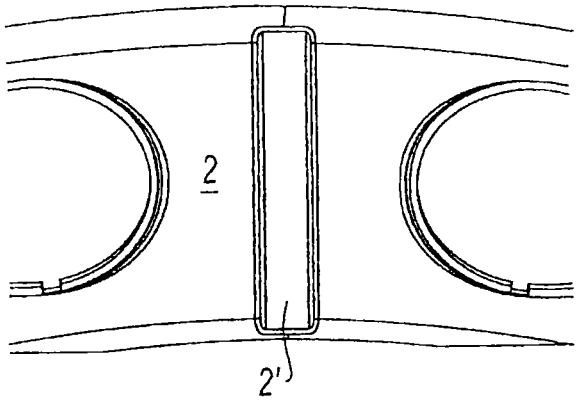
FIG. 11 shows, seen from above in the radial direction, the air gap between the wall of the chamber bottom and the joint cover at the connection between two adjacent baffles.

FIGS. 10 and 11 show an enhancement between the baffles and the chamber bottom. The chamber bottom 2 comprises a radial channel 2*r* in the zone where the joint cover of the join of the baffles is placed. This channel 2' makes it possible to arrange a sufficient air gap when the joint covers have a greater thickness than the clearance between the flat portion 20*a* of the baffle and the wall of the chamber bottom.

Figure 12:
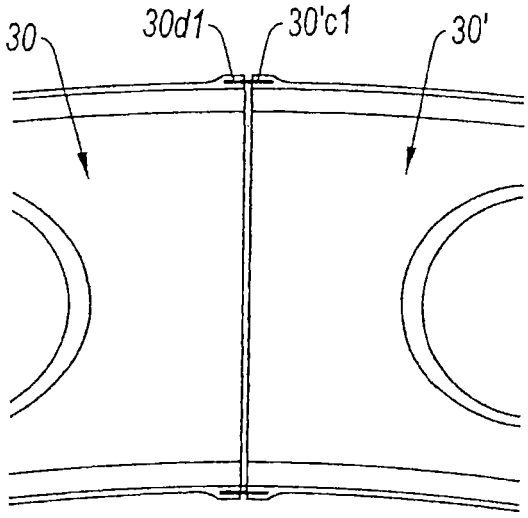
FIG. 12 shows another variant embodiment of the joint cover seen from the inside of the combustion chamber.
Figure 13:
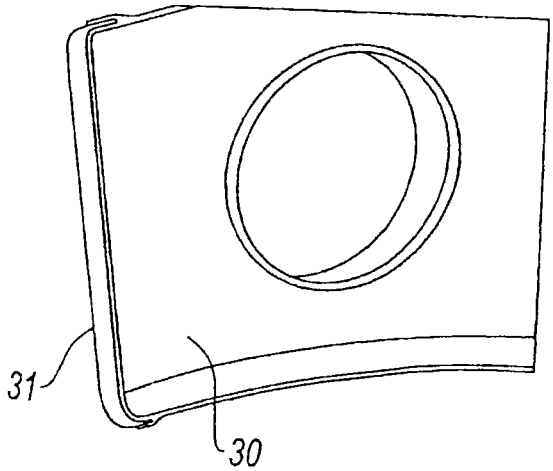
FIG. 13 shows the edge of a baffle of FIG. 12 with a tongue.
Figure 14:
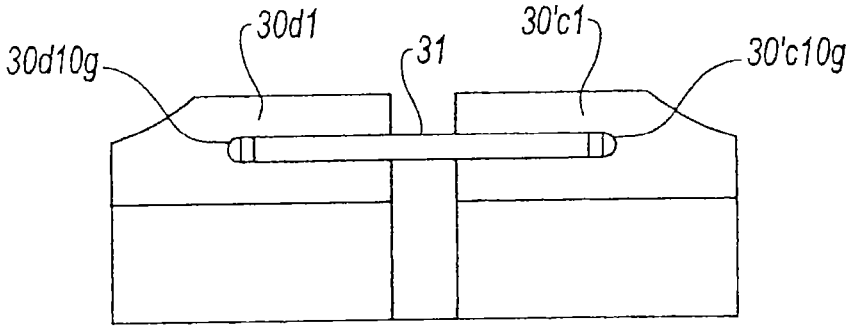
FIG. 14 shows the detail of the joint cover of FIGS. 12 and 13.

Another variant is shown in FIGS. 12, 13 and 14.

These show the baffles 30, 30' with a flat wall 30*a*, 30'*a*, a central opening 30*b*, 30'*b*, two longitudinal edges 30*c*, 30'*c* and 30*d*, 30'*d* and two rounded and curved transverse edges 30*e*, 30'*e* and 30*f*, 30'*f*. The two longitudinal edges 30*c*, 30*d*; 30'*c*, 30'*d* each comprise a tongue 30*c*1, 30*d*1; 30'*c*1, 30'*d*1 parallel to the wall of the baffle and arranging a groove-shaped housing 30*c*10*g* and 30*d*10*g*, 30'*c*10*g*, 304*d*10*g*. The grooves are arranged so as to interact with a metal fitted tongue 31. Therefore the tongue is housed in the adjacent grooves 30*d*10*g* and 30'*c*10*g*. The clearance is sufficient to allow the expansion of the combustion chamber during the different engine speeds while maintaining a sealed contact between the edge 20'*c* and the sides of the groove 20*d*10*g*.

The invention claimed is:

1. A baffle for a bottom of a combustion chamber of a gas turbine engine, comprising:

a flat portion of wall with an upstream face, a downstream face and an opening for an injector of the combustion chamber to pass through;

first and second longitudinal edges oriented in a radial direction relative to an axis of the engine; and first and second transverse edges which are rounded to follow the a curvature of the combustion chamber and curved towards an inside of the combustion chamber, wherein the first longitudinal edge includes a joint cover arranging a housing and the second longitudinal edge having a fitted tongue, wherein the first longitudinal edge cooperates with and covers the second longitudinal edge of an adjacent baffle so as to seal the junction between the two edges while allowing the baffles to slide relative to one another when the wall of the chamber bottom expands, wherein the tongue extends from a free edge of the first transverse edge along the upstream face of the flat portion to a free edge of the second transverse edge, wherein the tongue presents a groove-shaped housing, and wherein a plurality of the baffles cover an entire circumference of the combustion chamber.

2. The baffle as claimed in claim 1, wherein the housings are arranged equally along longitudinal edges of the curved portion of the transverse edges.

3. The baffle as claimed in claim 1, wherein the second longitudinal edge does not include a joint cover, the first and second longitudinal edges being matched in order to adapt to an edge of another same baffle placed edge-to-edge.

4. The baffle as claimed in claim 1, further comprising another joint cover along the second longitudinal edge.

5. The baffle comprising two longitudinal edges matching the joint covers of the baffle of claim 4.

6. The baffle as claimed in claim 1, wherein the groove-shaped housing cooperates with the second longitudinal edge of the adjacent baffle.

7. The baffle as claimed in claim 1, wherein the groove-shaped housing cooperates with a fitted tongue.

8. A combustion chamber of a gas turbine engine, being annular comprising an outer wall, an inner wall, a wall connecting the two walls and forming a chamber bottom, baffles as claimed in claim 1 and comprising a portion of wall parallel to the chamber bottom, being fitted in the bottom.

9. The combustion chamber as claimed in claim 8, comprising baffles including a joint cover along the first longitudinal edge and the second longitudinal edge does not include a joint cover, the first and second longitudinal edges being matched in order to adapt to an edge of another same baffle placed edge-to-edge, all of the baffles being identical.

10. The combustion chamber as claimed in claim 8, comprising baffles with the housing formed by the groove-shaped housing, all the baffles being identical, a metal tongue being housed in the grooves of the joint covers.

11. The combustion chamber as claimed in claim 8, comprising a first set of baffles including a joint cover along the first and second longitudinal edges, and a second set of baffles including first and second longitudinal edges matching the joint covers of the first set of baffles, wherein the first set of baffles alternate with the second set of baffles.

12. The combustion chamber as claimed in claim 8, wherein the chamber bottom comprises a channel arranging an air gap between the chamber bottom and the joint covers.

13. A chamber of the convergent type as claimed in claim 8.

14. A gas turbine engine comprising a combustion chamber as claimed in claim 8.

* * * * *

UNITED STATES PATENT AND TRADEMARK OFFICE

CERTIFICATE OF CORRECTION

PATENT NO. : 8,683,806 B2
APPLICATION NO. : 13/958000
DATED : April 1, 2014
INVENTOR(S) : Patrice Andre Commaret et al.

It is certified that error appears in the above-identified patent and that said Letters Patent is hereby corrected as shown below:

In the Specification

Column 5, line 19, change “304d10g” to --30d10g--; and

In the Claims

Column 5, line 35, change “follow the a curvature” to --follow a curvature--.

Signed and Sealed this
Eighth Day of July, 2014

Michelle K. Lee

Michelle K. Lee
*Deputy Director of the United States Patent and Trademark Office*